US011013386B2

(12) United States Patent
Zhu et al.

(10) Patent No.: US 11,013,386 B2
(45) Date of Patent: May 25, 2021

(54) ANTI-STATIC VACUUM CLEANER

(71) Applicant: TINECO INTELLIGENT TECHNOLOGY CO., LTD., Suzhou (CN)

(72) Inventors: Wenchao Zhu, Suzhou (CN); Zhenhua Zhang, Suzhou (CN)

(73) Assignee: TINECO INTELLIGENT TECHNOLOGY CO., LTD., Suzhou (CN)

( * ) Notice: Subject to any disclaimer, the term of this patent is extended or adjusted under 35 U.S.C. 154(b) by 345 days.

(21) Appl. No.: 16/085,571

(22) PCT Filed: Mar. 15, 2017

(86) PCT No.: PCT/CN2017/076705

§ 371 (c)(1),
(2) Date: Sep. 15, 2018

(87) PCT Pub. No.: WO2017/157292

PCT Pub. Date: Sep. 21, 2017

(65) Prior Publication Data

US 2020/0297177 A1 Sep. 24, 2020

(30) Foreign Application Priority Data

Mar. 16, 2016 (CN) ..... 201620201603.2

(51) Int. Cl.
*A47L 9/28* (2006.01)
*A47L 9/16* (2006.01)
(Continued)

(52) U.S. Cl.
CPC ..... *A47L 9/2857* (2013.01); *A47L 9/2884* (2013.01); *A47L 9/1683* (2013.01); *A47L 9/24* (2013.01); *A47L 9/2842* (2013.01); *A47L 9/322* (2013.01)

(58) Field of Classification Search
CPC .... A47L 9/2857; A47L 9/2884; A47L 9/1683; A47L 9/24; A47L 9/2842; A47L 9/322
See application file for complete search history.

(56) References Cited

U.S. PATENT DOCUMENTS 4,473,923 A * 10/1984 Neroni ..... A47L 9/246 15/377
4,697,300 A * 10/1987 Warlop ..... A47L 9/24 15/327.1

(Continued)

FOREIGN PATENT DOCUMENTS

CN 2188341 Y 2/1995
CN 1426754 A 7/2003

(Continued)

OTHER PUBLICATIONS

European Search Report in Application No. 17765834.1 dated Jul. 16, 2019.

(Continued)

*Primary Examiner* — Dung Van Nguyen
(74) *Attorney, Agent, or Firm* — Maschoff Brennan

(57) ABSTRACT

An anti-static vacuum cleaner is provided, which comprises a machine body, in which components on the machine body include a dust collecting component, a main body and a dust collector; the suction portion is communicated with the dust collector arranged on the main body, and a handle is arranged on the main body; the components on the machine body at least form a static electricity generating portion; the handle is at least partially formed by a non-metal conductive material, and is electrically connected with the at least one static electricity generating portion through an electrically conductive assembly. Additionally, the handle may be made by a non-metal conductive material that can increase its contact area with the human body for efficiency of electro- (Continued)

static conduction without affecting the feel of grasping, appearance and safety.

9 Claims, 2 Drawing Sheets

(51) Int. Cl.
*A47L 9/24* (2006.01)
*A47L 9/32* (2006.01)

(56) References Cited

U.S. PATENT DOCUMENTS 4,715,086 A * 12/1987 Johanson ..... A47L 9/2889 15/339
4,817,234 A * 4/1989 Greulich ..... A47L 9/2805 15/339
4,866,565 A * 9/1989 Wray, Jr. ..... A47L 9/24 361/215
6,301,743 B1 * 10/2001 Cloud, III ..... A47L 9/2842 15/339
2016/0015229 A1 1/2016 Conrad et al.

FOREIGN PATENT DOCUMENTS

CN 1472213 A 2/2004
CN 203000811 U 6/2013
CN 103356134 A 10/2013
CN 205612408 U 10/2016
JP 2007236426 A 9/2007
JP 2013212209 A 10/2013

OTHER PUBLICATIONS

Ishida et al., Database WPI, Clarivate Analytics, vol. 2013, No. 70, Database accession No. 2013-R22078, XP002792694, Oct. 17, 2013(Hitachi Appliances Inc).

* cited by examiner

ANTI-STATIC VACUUM CLEANER

FIELD

The embodiments discussed herein are related to an anti-static vacuum cleaner.

BACKGROUND

Static electricity may be produced during operation of vacuum cleaners. On one hand, it may cause damage to the circuit of the entire machine; on the other hand, if it is accumulated excessively, the phenomenon of static strike to hands may occur when a user contacts the machine.

The subject matter claimed herein is not limited to embodiments that solve any disadvantages or that operate only in environments such as those described above. Rather, this background is only provided to illustrate one example technology area where some embodiments described herein may be practiced.

SUMMARY

An anti-static vacuum cleaner may include a machine body and components on the machine body including a dust collecting component, a main body and a dust collector, in which: the suction portion is communicated with the dust collector arranged on the main body, and a handle is arranged on the main body; the components on the machine body at least form a static electricity generating portion; the handle is at least partially formed by a non-metal conductive material; and the handle is electrically connected with the at least one static electricity generating portion through an electrically conductive assembly.

BRIEF DESCRIPTION OF THE DRAWINGS

Example embodiments will be described and explained with additional specificity and detail through the use of the accompanying drawings in which.

DESCRIPTION OF EXAMPLE EMBODIMENT

Currently, the commercially available solution for static electricity elimination and/or reduction is to additionally arrange an independent wire between the metal pipe and the handle. For example, the generated static electricity may be transferred to a metal ring on the handle via a wire; then, under the action of the contact between the metal ring and a human body, said static electricity may be guided into the ground through the human body. For example, Chinese Patent No. CN203000811U discloses an anti-static vacuum cleaner air channel, which comprises a steel sheet that is at least partially exposed outside and electrically connected with a metal expansion pipe and a wired hose. Theoretically, such a configuration can achieve the elimination and/or reduction of static electricity. However, during application by a user, as the area of contact between the steel sheet and the human body is relatively small, the contact between the steel sheet and the human body may be poor, such that the static phenomenon still exists.

Figure 1:
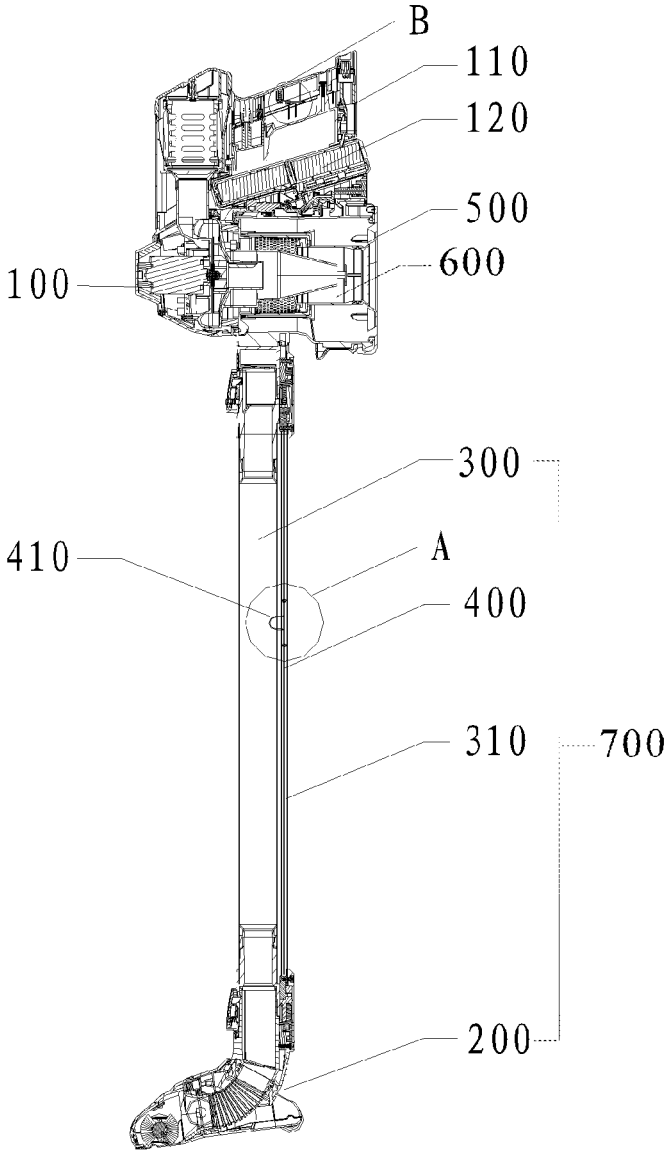
FIG. 1 illustrates a structural schematic diagram of an anti-static vacuum cleaner of the present disclosure.

Aspects of the present disclosure, as described below, address these and other problems with conventional methods and systems. Turning to the figures, FIG. 1 is a structural schematic diagram of an anti-static vacuum cleaner of the present disclosure. As shown in FIG. 1, the anti-static vacuum cleaner of this disclosure comprises a machine body 100 and a handle 110. During operation of the anti-static vacuum cleaner, a user operates it to collect dust by grasping its handle 110. The machine body 100 comprises a dust collecting component 700, a main body 500 and a dust collector 600. In these or other embodiments, the dust collecting component 700 is communicated with the dust collector 600 arranged on the main body 500, and the handle 110 is arranged on the main body 500. Additionally or alternatively, a vacuum motor is further arranged on the main body 500, and a rolling brush motor is arranged on the dust collecting component 700 for driving a rolling brush to rotate. During operation of the anti-static vacuum cleaner of this disclosure, a power source supplies power to such apparatuses as the rolling brush motor and the vacuum motor through a power supply line 400.

In some embodiments, a dust-containing airflow is sucked up by the dust collecting component 700, and then delivered into the dust collector 600 for gas-solid separation. The dust collecting component 700 may comprise a floor brush 200 and a metal expansion pipe 300, in which one end of the metal expansion pipe 300 is connected with the floor brush 200 through a hose. Alternatively, the dust collecting component 700 is a hose. The specific structure of said dust collecting component is not limited in this disclosure.

As the anti-static vacuum cleaner sucks up dust during operation, static electricity may be generated and accumulated on a plurality of parts thereof. In this disclosure, the component on the machine body 100 that is prone to generate static electricity is defined as a static electricity generating portion, which may comprise the dust collecting component, the main body 500, the dust collector, etc. In these or other embodiments, to reduce the influence of static electricity on the anti-static vacuum cleaner, the static electricity generating portion in this disclosure may be electrically connected with the handle 110 through an electrically conductive assembly. In some embodiments, the above electrically conductive assembly may be many in number and/or include a variety of different electrically conductive components. For example, a steel wire, steel bar or steel sheet may be welded between the static electricity generating portion and the handle 110. Additionally or alternatively, one end of the steel wire may be wound (e.g., directly) around the static electricity generating portion, and the other end of the same may be wound around the handle 110. These and other methods for electric connection may be applied to this disclosure.

The handle 110 is at least partially formed by a conductive material, in which the conductive material may be either a metal conductive material or a non metal conductive material. In some embodiments, the non metal conductive material is a thermoplastic polyurethane elastomer rubber (electrically conductive TPU) added with such conductive impurities as metal filings, which has a resistivity of between 104Ω and 109Ω. In these or other embodiments, the electrically conductive TPU having a mark of TPU (K75A) may be used as the conductive material. As compared with traditional metal conductive sheets, the electrically conductive TPU may increase the area of contact between the conductive material and the human body helping to increase efficiency of electrostatic conduction without affecting the feel of grasping, appearance and safety. For example, the handle 110 comprises a handle body and a conductive layer coated on the inner side and/or the outer side of the handle body. Additionally or alternatively, the conductive layer may be composed of the electrically conductive TPU. In some embodiments, the handle 110 is entirely formed by the electrically conductive TPU.

In some embodiments, the electrically conductive assembly may be the power supply line 400, e.g., to help reduce costs. For example, the anti-static vacuum cleaner of this disclosure is a battery-driven vacuum cleaner, such as a portable hand-held vacuum cleaner. For example, the main body 500 may be arranged therein with a battery pack 120 which can supply power to the anti-static vacuum cleaner through the power supply line 400. In some embodiments, the anti-static vacuum cleaner operates at a safety voltage. For example, in these or other embodiments, a voltage of 22.2 V may be used as the operating voltage. Additionally or alternatively, the anti-static vacuum cleaner is powered by six 3.7 V batteries. To reduce and/or eliminate the influence of the power supply line on the human body and to reduce and/or eliminate the influence of static electricity on electronic elements in the anti-static vacuum cleaner, the static electricity generating portion and the handle 110 have no load between access points on the power supply line 400. In some embodiments, the access points of the static electricity generating portion and the handle 110 on the power supply line 400 are located on one wire.

An example is given below for illustration, in which the metal expansion pipe 300 is electrically connected with the handle 110 through the power supply line 400. In some embodiments, other static electricity generating portions may also be electrically connected with the handle 110 in a similar manner. The type of the static electricity generating portions connected electrically with the handle 110 is not specifically limited in this disclosure. As such, those skilled in the art may conduct designing based on actual requirements, for example, if at least one of the static electricity generating portions is electrically connected with the handle 110.

Figure 2:
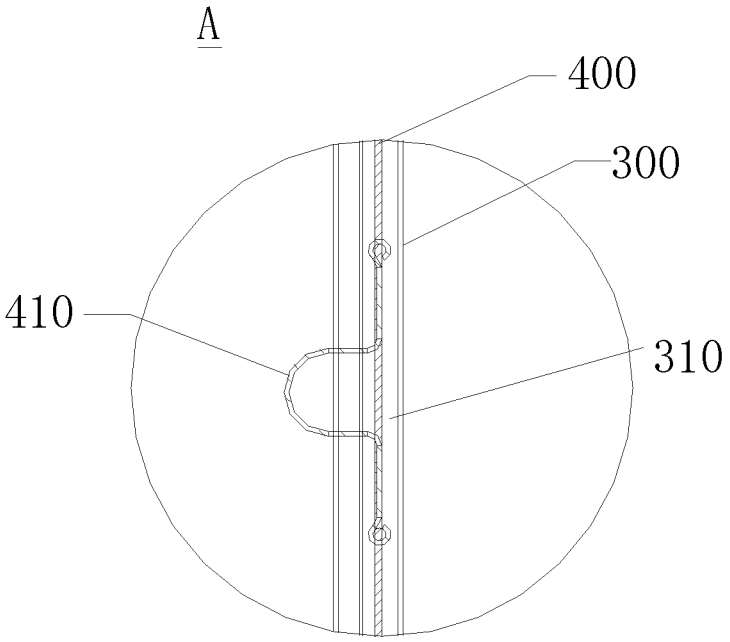
FIG. 2 illustrates an enlarged diagram of the detail indicated by A in FIG. 1.
Figure 3:
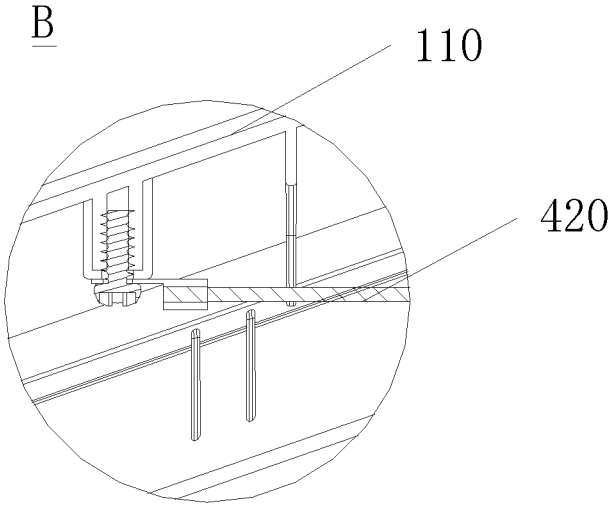
FIG. 3 illustrates an enlarged diagram of the detail indicated by B in FIG. 1.

To facilitate the wiring operation, the anti-static vacuum cleaner may be arranged with a recess 310 or a fixing member such as clips for fixing the power supply line 400, in which the power supply line 400 is fixed in the anti-static vacuum cleaner using the recess 310 or clips. In the case that clips are employed, they may be first mounted on the wiring path of the power supply line 400; then, the power supply line 400 may be clipped into corresponding clips during wiring. FIG. 2 illustrates an enlarged diagram of the detail indicated by A in FIG. 1, and FIG. 3 illustrates an enlarged diagram of the detail indicated by B in FIG. 1. As shown in FIGS. 1-3, the metal expansion pipe 300 may be arranged therein with a recess 310. Additionally or alternatively, the power supply line 400 connected electrically with the battery pack 120 of the main body 500 may be electrically connected with the rolling brush motor arranged on the floor brush 200 through the recess 310.

In these or other embodiments, both the power supply line 400 and the metal expansion pipe 300 are manufactured as independent components, and to avoid or reduce an additional increase in the production cost, the metal expansion pipe 300 may be electrically connected with the power supply line 400 through a first metal wire 410, and the power supply line 400 may be electrically connected with the handle 110 through a second metal wire 420. The above metal wires may be connected with the foregoing components via crimping, welding and other processes.

For example, two ends of the first metal wire 410 are bent to be in an annular shape and sleeved on the power supply line 400, and the central portion of the first metal wire 410 is bent to form a protrusion that comes in contact with the metal expansion pipe 300. Additionally or alternatively, one end of the second metal wire 420 is connected with the power supply line 400, while the other end of the same is a connecting end (e.g., a wire nose) that is fixed in the handle 110 via a screw. The structures and connection manners of the above metal wires may be flexible, thereby facilitating the mounting operation.

In these or other embodiments, the metal expansion pipe 300 generates static electricity during operation of the anti-static vacuum cleaner. As it is electrically connected with the handle 110, said static electricity may be transferred to the handle 110 along the power supply line 400. Additionally or alternatively, the static electricity may then be guided into the ground through the human body in a timely manner.

Thus, in some embodiments, in the anti-static vacuum cleaner of this disclosure, the handle made by a thermoplastic polyurethane elastomer rubber for the purpose of eliminating static electricity can increase its contact area with the human body for efficiency of electrostatic conduction without affecting the feel of grasping, appearance and safety. Such a configuration, compared with a traditional metal ring, exhibits more reliable electrostatic conduction.

In accordance with common practice, the various features illustrated in the drawings may not be drawn to scale. The illustrations presented in the present disclosure are not meant to be actual views of any particular apparatus (e.g., device, system, etc.) or method, but are merely idealized representations that are employed to describe various embodiments of the disclosure. Accordingly, the dimensions of the various features may be arbitrarily expanded or reduced for clarity. In addition, some of the drawings may be simplified for clarity. Thus, the drawings may not depict all of the components of a given apparatus (e.g., device) or all operations of a particular method.

Terms used in the present disclosure and especially in the appended claims (e.g., bodies of the appended claims) are generally intended as "open" terms (e.g., the term "including" should be interpreted as "including, but not limited to," the term "having" should be interpreted as "having at least," the term "includes" should be interpreted as "includes, but is not limited to," etc.).

Additionally, if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations.

In addition, even if a specific number of an introduced claim recitation is explicitly recited, such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." or "one or more of A, B, and C, etc." is used, in general such a construction is intended to include A alone, B alone, C alone, A and B together, A and C together, B and C together, or A, B, and C together, etc. For example, the use of the term "and/or" is intended to be construed in this manner.

Further, any disjunctive word or phrase presenting two or more alternative terms, whether in the description, claims, or drawings, should be understood to contemplate the possibilities of including one of the terms, either of the terms, or both terms. For example, the phrase "A or B" should be understood to include the possibilities of "A" or "B" or "A and B."

Additionally, the use of the terms "first," "second," "third," etc., are not necessarily used in the present disclosure to connote a specific order or number of elements. Generally, the terms "first," "second," "third," etc., are used to distinguish between different elements as generic identifiers. Absence a showing that the terms "first," "second," "third," etc., connote a specific order, these terms should not be understood to connote a specific order. Furthermore, absence a showing that the terms first," "second," "third," etc., connote a specific number of elements, these terms should not be understood to connote a specific number of elements. For example, a first widget may be described as having a first side and a second widget may be described as having a second side. The use of the term "second side" with respect to the second widget may be to distinguish such side of the second widget from the "first side" of the first widget and not to connote that the second widget has two sides.

All examples and conditional language recited herein are intended for pedagogical objects to aid the reader in understanding the present disclosure and the concepts contributed by the inventor to furthering the art, and are to be construed as being without limitation to such specifically recited examples and conditions. Although embodiments of the present disclosure have been described in detail, it should be understood that the various changes, substitutions, and alterations could be made hereto without departing from the spirit and scope of the present disclosure.

What is claimed is:

1. An anti-static vacuum cleaner comprising:

a machine body; and components on the machine body including a dust collecting component, a main body and a dust collector, wherein:

the dust collecting component is communicated with the dust collector arranged on the main body, and a handle is arranged on the main body, the components on the machine body at least form a static electricity generating portion, the handle is at least partially formed by a thermoplastic polyurethane elastomer rubber added with conductive impurities, and the handle is electrically connected with the at least one static electricity generating portion through an electrically conductive assembly.

2. The anti-static vacuum cleaner of claim 1, wherein the handle comprises:

a handle body and a conductive layer coated on one or both of an inner side and an outer side of the handle body, the conductive layer composed of the thermoplastic polyurethane elastomer rubber added with conductive impurities.

3. The anti-static vacuum cleaner of claim 2, wherein the electrically conductive assembly is a steel wire, a steel bar or a steel sheet.

4. The anti-static vacuum cleaner of claim 2, wherein:

the machine body is arranged therein with a battery pack which supplies power to the anti-static vacuum cleaner through a power supply line; and the electrically conductive assembly is the power supply line.

5. The anti-static vacuum cleaner of claim 1, wherein the electrically conductive assembly is a steel wire, a steel bar or a steel sheet.

6. The anti-static vacuum cleaner of claim 1, wherein:

the machine body is arranged therein with a battery pack which supplies power to the anti-static vacuum cleaner through a power supply line; and the electrically conductive assembly is the power supply line.

7. The anti-static vacuum cleaner of claim 6, wherein:

the power supply line is electrically connected with the at least one static electricity generating portion through a first metal wire; and the power supply line is electrically connected with the handle through a second metal wire.

8. The anti-static vacuum cleaner of claim 7, wherein:

two ends of the first metal wire are bent to be in an annular shape and sleeved on the power supply line;

a central portion of the first metal wire is bent to form a protrusion that comes in contact with the at least one static electricity generating portion; and one end of the second metal wire is connected with the power supply line, while the other end of the same is a connecting end that is fixed in the handle via a screw.

9. The anti-static vacuum cleaner of claim 1, wherein:

the dust collecting component comprises a metal expansion pipe and a floor brush; and one end of the metal expansion pipe is connected with the floor brush through a hose.

* * * * *